United States Patent [19]

Alexandre et al.

[11] Patent Number: 4,838,435

[45] Date of Patent: Jun. 13, 1989

[54] INSTALLATION FOR PROCESSING PHOTOGRAPH ENVELOPES

[75] Inventors: Bernard Alexandre, Vienne; Jean-Paul Cornillon, Annonay; Georges Rollet, Les Cotes d'Arey, all of France

[73] Assignee: Societe Inter-Color, Lyons, France

[21] Appl. No.: 198,805

[22] Filed: May 25, 1988

[30] Foreign Application Priority Data

Jun. 11, 1987 [FR] France ..... 87 08566

[51] Int. Cl.[4] ..... B07C 5/00; B07C 1/10

[52] U.S. Cl. ..... 209/555; 53/52; 198/396; 198/453; 209/584; 209/598; 209/900; 209/914; 354/105; 364/478

[58] Field of Search ..... 209/555, 556, 583, 584, 209/588, 598, 601, 603, 604, 547, 548, 900, 905, 910, 914; 364/478; 198/396, 453, 455; 414/403, 411, 412; 53/52, 381 R; 354/105, 106, 109

[56] References Cited

U.S. PATENT DOCUMENTS

| | | | |
|---|---|---|---|
| 2,984,349 | 5/1961 | Mathis | 209/555 |
| 3,799,337 | 3/1974 | Green | 209/900 X |
| 4,186,837 | 2/1980 | Popiel | 209/598 X |
| 4,688,678 | 8/1987 | Zue et al. | 209/900 X |
| 4,791,279 | 12/1988 | Signoretto | 354/105 X |

FOREIGN PATENT DOCUMENTS

| | | | |
|---|---|---|---|
| 0108987 | 5/1984 | European Pat. Off. | 209/583 |
| 0214096 | 3/1987 | European Pat. Off. | 209/583 |
| 0215469 | 3/1987 | European Pat. Off. | 209/900 |

*Primary Examiner*—Robert B. Reeves
*Assistant Examiner*—Donald T. Hajec
*Attorney, Agent, or Firm*—Browdy & Neimark

[57] ABSTRACT

An installation for processing of photograph envelopes intended to equip a large photography processing laboratory. The installation includes a picking station, a bar code reading station, a thickness detection station, a station for recognition of shapes and characters, a manual input and introduction station, a marking station, and finally a station for feeding a traditional sorting machine.

6 Claims, 3 Drawing Sheets

FIG. 4
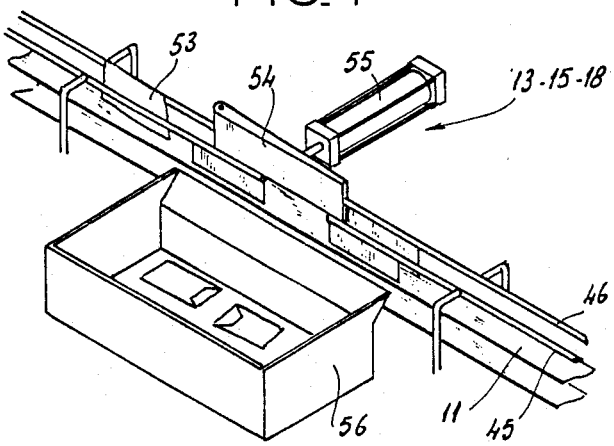
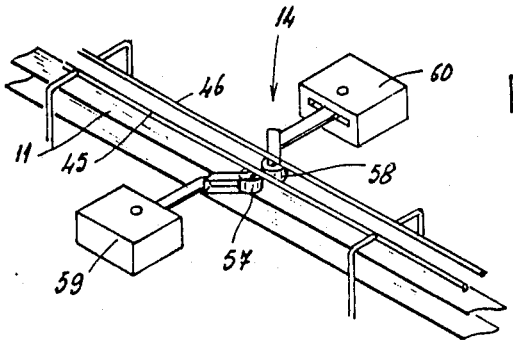
FIG. 5
FIG. 6
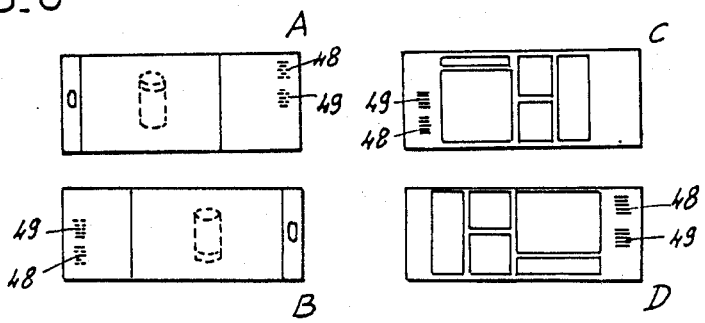

INSTALLATION FOR PROCESSING PHOTOGRAPH ENVELOPES

BACKGROUND OF THE INVENTION

1. Field Of The Invention

This invention relates to an installation for processing photograph envelopes intended to equip a large photography processing laboratory.

2. The Prior Art

Generally, orders for photography work are given by customers to a retailer, small-businessman or employee of a department store, who places the photographs to be processed (film, disk, paper print, transparency, etc.) in a special rectangular envelope whose one side is transparent and whose other side carries various indications relative to the work to be done, and two bar codes, including a code for the retailer and an identification code for the order corresponding to this envelope.

These envelopes are placed by the retailer in boxes placed in front of the store, and specialized teams collect them each night and take them before daybreak to the processing laboratory where they are stored in bulk in the containers that were used to transport them.

Then the envelopes are sorted by hand by common final technical characteristics (for example, size of film, surface condition of paper: dull or glossy, size of paper print) to form batches.

Each of these batches is then carried to a first processing station where the films, for example, are removed from their envelopes, then glued end-to-end with simultaneous marking of each film and each envelope to obtain, on the one hand, a cassette containing the marked films, glued end-to-end, and on the other hand, a stack of empty envelopes placed in the same order as these films and marked.

This cassette and pile of associated envelopes are then carried to a second photographic processing station, for example, development of the negatives in the case considered, and so on, the stack of envelopes constantly following the corresponding photographic prints.

At the end of technical treatment, the finished prints (negatives or paper prints, for example) are replaced in the corresponding envelopes, on which are then written by hand the number of processed photographs (paper prints in the example considered) and the charge code intended for billing and depending on the photographic processing performed.

The closed envelope is then routed to the charge station where the billing is performed. It is an automatic machine comprising a keyboard on which an operator keys in the number of prints and the charge code which is read on the envelope. This keyboard is connected to a central computer which, as a function of these two latter data and of the identification bar code of the retailer which is read from the envelope placed on the machine for this purpose, the price to be billed is deduced and its automatic printing on the envelope is ordered. At this machine the bar code representing the order number is also read from the envelope, which order number is then (or only now) recorded by the central computer.

The envelopes are then routed to an automatic sorting machine, for example of the "LASER SORT" (registered trademark) to be grouped by addresses of the retailers and finally routed to them.

These traditional installations have the following drawbacks.

The envelope input sorting, which is done manually and at night, requires an increase of manpower proportional to the increase of the volume of customized options or production cycle reductions. Training of seasonal personnel has to be performed each year at the necessary periods. The sorting is performed in cascade with loss of information on the identification factor of the preceding step. It is slow, limited in its capacity, and a source of error. Any change in products, of circuits, causes errors.

Marking of the input date is not performed, which does not make it possible to have reliable, controlled information on the date received by the laboratory, and handicaps the management of deadlines.

With regard to identification of the order, a number of problems may arise.

For films with development, after input sorting and gluing, the number of batches to be produced by film size and by type of surface option, by paby size, and commercial circuit of associated envelopes by lot are known. Therefore, optionally it is possible to deduce the amount to be processed. This information is not input or associated with the client or the order number. It is not processed and is lost on the statistical level.

For flat envelopes (reprints), this information is not input in the laboratory, after end sorting without recording and without knowledge of the volume.

For the reporting studio, processing of the photography work, the envelopes are recorded with a bar-code reading device, but the type of order is not associated with the envelope number or the client's number.

Absence of the knowledge of the order book upstream from production does not make it possible to have a short-term forward-looking organization of production. Yet this knowledge is essential to know the loads and bottlenecks, to assure following of service, and to reduce costs and delays.

Billing is extremely slow, with high risks of error (it is known that statistically a keyboard input causes one error in 300), is not flexible (prevents customizing), and goes slower the more the volume increases. Input errors to the disadvantage of the laboratory are rarely recoverable.

Marking and date of output from the laboratory are not performed. The order book is known only at the moment of charging, when the product leaves the company.

The output sorting is performed at least partially on an automatic very expensive sorting machine, whose rate of use is extremely slow.

SUMMARY OF THE INVENTION

The present invention aims at remedying all these drawbacks. It relates to an installation for semiautomatic processing, at the input and output of the laboratory, of envelopes containing photographs, respectively before photographic processing then after photographic processing of the latter. This semiautomatic installation comprises a series of stations in cascade forming a continuous chain with, from upstream to downstream:

a device for automatic feeding and picking of envelopes, arranged to provide these envelopes one by one, standing on edge and on their large side, to an advancing conveyor;

a device for automatically reading of the bar codes carried on the envelope, followed by a device for automatically ejecting unread envelopes;

a device for automatically checking the thickness of the envelopes, followed by a device for automatically ejecting envelopes that are too thick;

a device for automatic recognition of the shape of the films contained in the envelopes, as well as of the characters written on the envelope, followed by a device for automatically ejection of envelopes whose shape has not been recognized and/or whose characters have not been read;

a device for manual inputting and introducing into the line the previously rejected envelopes or the envelopes having special characteristics;

a device for automatic marking of the envelopes;

a device for automatic synchronization and feeding of envelopes to a sorting machine;

a central computer which receives and records the various data coming from the different stations, and consequently provides synchronized orders to these stations.

The order of the successive stations between the feeding and picking station and the station for manual introduction of rejected or special envelopes can be of any type. The different ejection stations can be placed at various points in the line, and be grouped in two or even one ejection station.

BRIEF DESCRIPTION OF THE DRAWINGS

In any case, the invention will be better understood and its advantages and other characteristics will come out, during the following description of a nonlimiting embodiment, with reference to the accompanying diagrammatic drawings, in which:

FIG. 4 is a perspective view of an ejection station;

FIG. 5 is a perspective view of the station for checking the thickness of the envelopes; and FIG. 6 shows the four possible positions of an envelope on edge at the output of the automatic feeding and picking station.

DETAILED DESCRIPTION OF THE DRAWINGS

Figure 1:
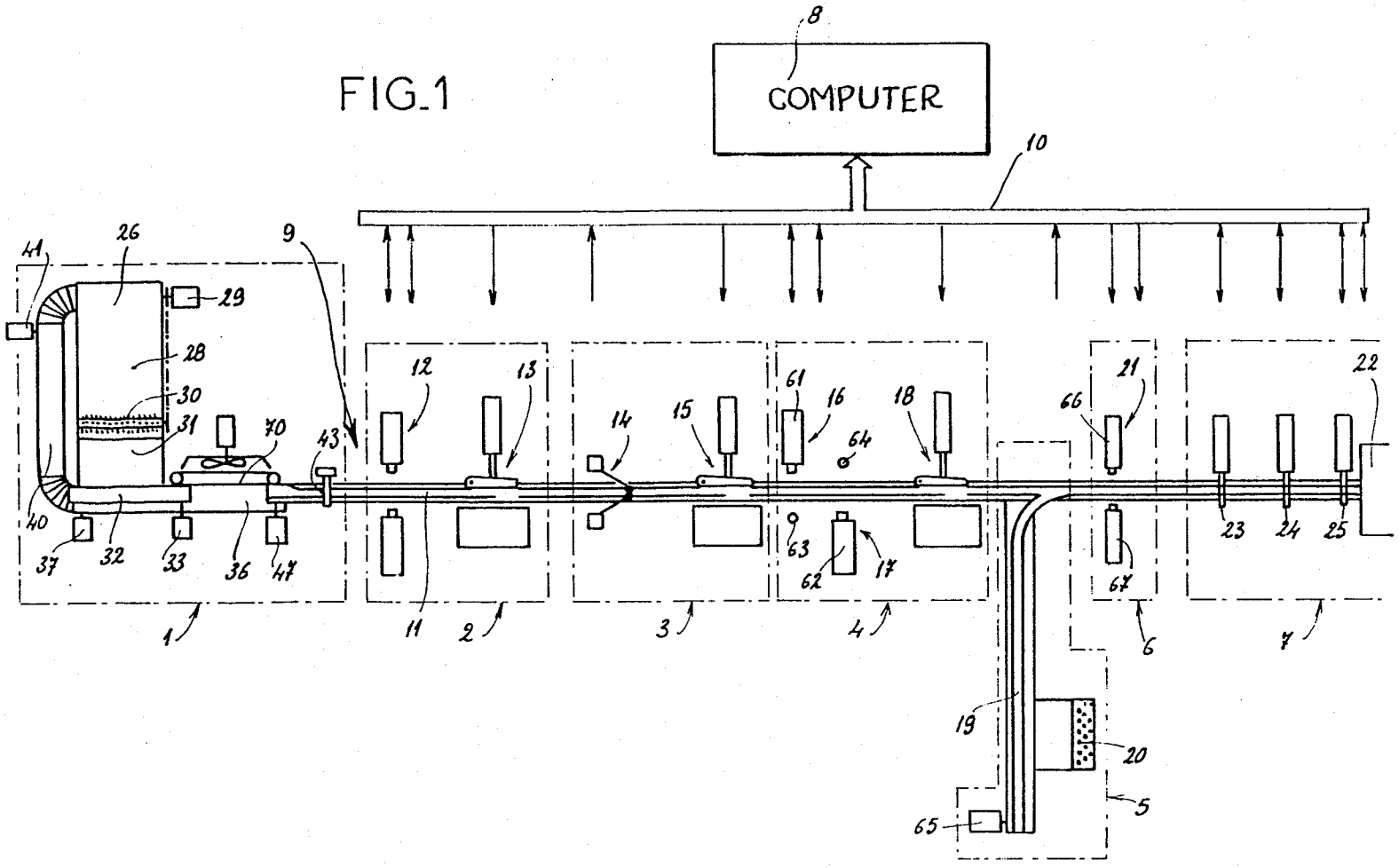
FIG. 1 is a very simplified plan view of this semiautomatic installation.

Referring first to FIG. 1, this machine for automatic processing of filled envelopes, at the input and output of the photography processing laboratory, is in the form of a continuous line 9, comprising several stations 1 to 7 in cascade connected by a local network 10 to a central computer 8. The relative positions of first station 1, and those of the two last stations 6, 7 are frozen. On the other hand, those of the four intermediate stations 2, 3, 4 and 5 can be other than those according to the present embodiment. These successive stations are as follows.

Station 1 is the station for automatic feeding and picking of the envelopes. This first station has the role of providing envelopes, one by one, standing on the edge and on their large side, to an advancing conveyor 11 of line 9.

Station 2 comprises successively a device 12 for reading the bar codes carried on each envelope, and a device 13 for ejection of envelopes whose bar codes were not read correctly.

Station 3 comprises a device 14 for automatic checking the thickness of the envelopes, followed by a device 15 for ejection of envelopes which are too thick.

Station 4 comprises successively a device 16 for recognizing the shape of the content of the envelope by silhouette, a device 17 for reading the characters (other than bar codes) written on the envelope, or vice versa, and a device 18 for ejection of envelopes the shape of whose content has not been correctly recognized and/or those of whose written characters have not been read correctly.

At station 5, the particular envelopes, for example previously ejected, are introduced manually into line 9 by means of a lateral conveyor, after their characteristics have been manually input on a keyboard 20 connected to computer 8 by local network 10.

Station 6 comprises a device 21 for marking the envelopes with ink jets: marking of the input date and chronological input number, marking of the charge (billing) and the output date at the output.

Station 7 is a station for automatic synchronization and feeding of envelopes to a sorting machine 22, for example, a traditional machine of the LASERSORT type. It comprises several accumulation flaps 23, 24 and an input flap 25 for sorting machine 22.

These successive stations will now be described in greater detail with reference to the set of FIGS. 1 to 6.

Figure 2:
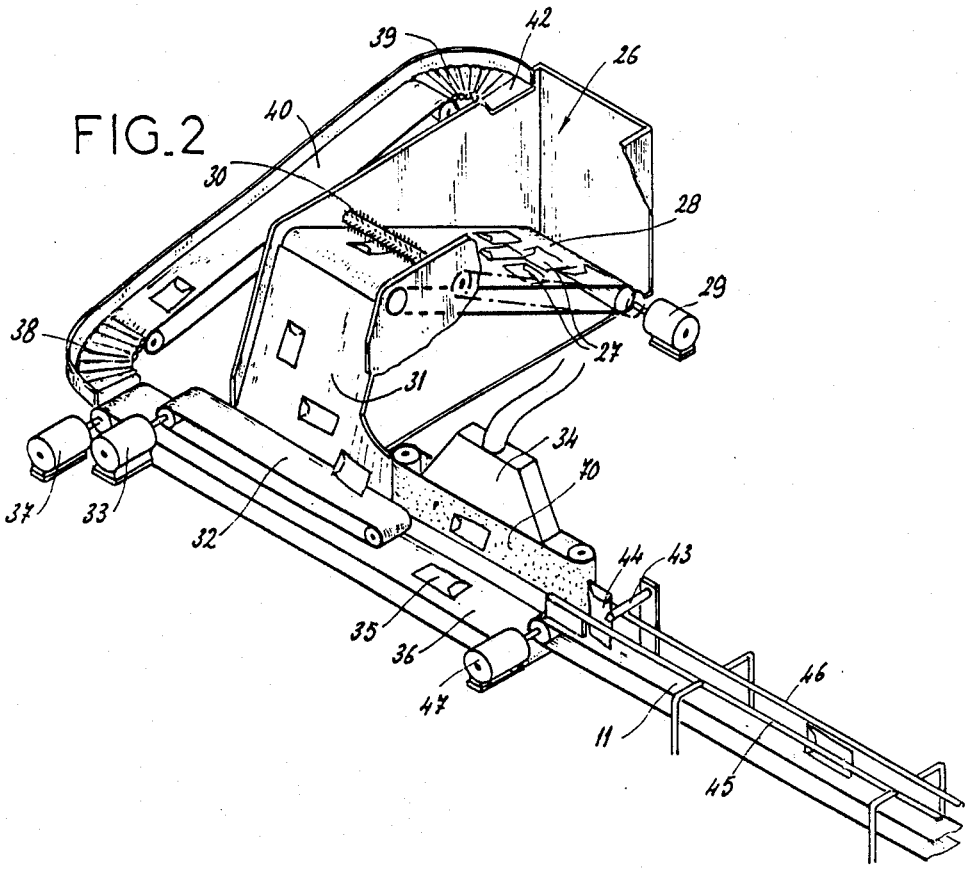
FIG. 2 is a perspective view, partially cut away, of the automatic feeding and picking station.

Station 1 is represented in detail in FIG. 2. It comprises a hopper 26 for receiving envelopes 27, this hopper having an acceptance capacity of about 1000 envelopes, for example. On its bottom it comprises an elevator conveyor belt 28 with an adhering conveyor belt driven at an adjustable speed by an electric motor 29.

An expelling brush 30 is driven in rotation by motor 29 in the same direction as endless belt 28. It is placed on belt 28, upstream and at a height regulated to allow the passage, by thickness, between the brush and belt, of one and only one envelope; if two envelopes are superposed, the top envelope is expelled to the bottom of the hopper.

At the output of the endless elevator belt 28 is placed a gravity output ramp 31 consisting of a stainless steel bed plate with an adjustable slope.

The envelopes finally fall, on the edge, standing up or lying down, on a receiving belt 32 consisting a horizontal endless belt driven by a motor 33. At the output of this belt 32, they are flattened by suction on a suction conveyor belt 70 consisting of an endless vertical belt, made of a material which is permeable to air, and a suction hood 34. Envelopes 35 which, despite expelling brush 30, have remained superposed on one another, then fall onto a return conveyor belt 36, made up of an endless belt driven by a motor 37, which is followed by a recycling ramp (return to hopper 26) comprising two right-angle transfer connections 38,39, an endless belt 40 driven by a motor 41 (FIG. 1), and a chute 42 for introducing the envelopes into hopper 26.

At the output of separation conveyor belt 70, a dimension stop 43 makes vertical envelopes 44 swing into a horizontal position. The envelopes are then routed and placed longitudinally on edge in the direction of their length, between two guide ramps 45 and 46, one behind the other on the general conveyor belt of line 9 which is made up of an endless belt 11 driven by a motor 47. The envelopes are then in one of four positions A,B,C,D drawn in FIG. 6.

Figure 3:
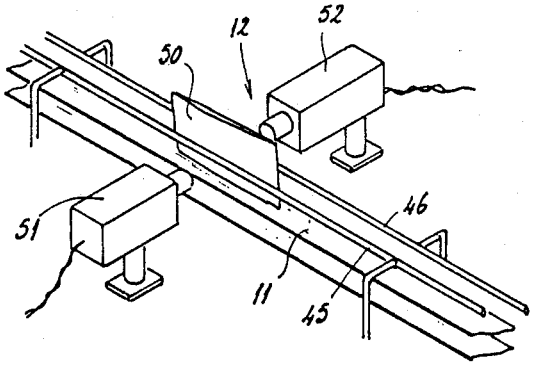
FIG. 3 is a perspective view of the station for automatic reading of the bar codes.

These envelopes 50 then pass by device 12 for reading bar codes 48 and 49 (FIG. 6), which is shown in detail in FIG. 3. This device uses a photoelectric cell (not shown) whose blackout by envelope 50 signals to computer 8 the arrival of this envelope, and two bar code readers 51, 52 of the scanner type which are located on both sides of conveyor belt 11 so as to be able to read codes 48, 49 regardless of position A,B,C or D, of envelope 50.

The origin of the message (scanner 51 or scanner 52) gives the computer an indication of the position (C,D or A,B respectively) of the faces of the envelope, while the delay between the blackout of the presence cell and arrival of the message which gives an indication of the position of the code on the envelope (at the front as in A and D, or at the back as in B and C).

In case neither of the two scanners 51, 52 sends a correct message, the unread envelope 53 is evacuated laterally, by an ejector 13 consisting of a flap 54 operated by a pneumatic cylinder 55, into a box 56 for recovery of unread envelopes.

The other envelopes continue their travel on conveyor belt 11, between two guide bars 45 and 46, to reach station 3, whose first portion is drawn in FIG. 5.

Detection of too thick envelopes is performed simply by means of two hinged sensors 57, 58 which are each connected to a case 59. 60 which protects an end-of-travel contactor. The two sensors 57, 58 are separated by a distance equal to the maximum allowable thickness of the envelopes. Too large envelopes separate the sensors from one another and consequently trigger at least one of the two end-of-travel contactors, which gives computer 8 information on the excess thickness. Too large an envelope is then evacuated thanks to ejection device 15 (FIG. 1), identical with device 13 described above (FIG. 4).

The unejected envelopes then go on to station 4, where an input photoelectric cell (not shown) of the station provides a signal of the presence of an envelope. Each of devices 16 and 17 is equipped with a camera 61, 62 opposite which is placed, on the other side of line 9, a high-powered lighting lamp 63, 64, for example, of the halogen or fluorescent type.

As a function of the information on the position of the envelope which is collected at station 2, the computer gives to camera 61 or camera 62, depending on the case, the task of recognizing shapes or characters. It also selects the necessary corresponding lighting.

Recognition of shapes is performed by determination of the overall characteristics (surface, perimeter) of the size of the film, which is seen in silhouette due to the lighting (63 or 64, depending on the case) which is located behind the envelope.

Reading of characters is performed by the other camera in a window located in the front or back of the envelope and in one direction or the other depending on the information given by station 2. Lighting is then of the fluorescent type and located in front of the envelope.

In case of nonrecognition of shapes or nonreading of the characters, the envelope under consideration is evacuated by device 18, which is also identical with station 13 of FIG. 3.

At station 5, the previously ejected envelopes as well as the special envelopes are input manually using keyboard 20 and inserted in line 9 by lateral conveyor belt 19 driven by a motor 65.

All the envelopes are then routed by line 9 to marking station 6. There also a photoelectric cell (not shown) which signals the input of an envelope into this marking zone.

Marking device 21 is equipped with two identical ink jet markers 66, 67, which are placed face to face, on both sides of line 9.

Depending on the position of the envelope (detected at station 9 or fixed for the envelopes introduced at station 5), computer 8 gives an order to one or the other marking head 66, 67 and gives it the direction of the marking. The input date is marked at the input, and the billing and output date are marked at the output. In addition to the input date, each envelope receives a chronological number making it possible to individualize it: all the information relating to the envelope is associated in the memory with this number. A batch number is also printed.

At station 7, the envelopes are introduced directly in sorting machine 22 by an accumulation and synchronization device with several barriers 23, 24, and 25; there is a creation of a buffer zone making a queue for introduction of the envelopes. This zone preferably comprises five barriers, only three of them being represented in FIG. 1.

The presence of an envelope in this buffer zone triggers the closing of the barrier located behind this envelope. When the latter barrier is closed, the buffer zone is saturated and the conveyor belt stops. The feeding of the envelopes to the containers of sorting machine 22 is performed by a helical ramp (not shown). The last barrier 25 is located at the upstream end of this ramp, closer to the containers to facilitate introduction.

The out-of-size envelopes are input by a terminal connected to computer 8 and processed manually.

The machine that has just been described functions both at the input of the envelopes to the laboratory, before photographic processing, and at the output of the laboratory, after photographic processing.

At the input, it indexes and marks the envelopes before sorting them in machine 22, and at the output it again marks the envelopes (date of output and billing), before again sorting them for sending them back to the retailers.

Of course, the invention is not limited to the embodiment that has just been described. The machine, for example, can be made up of a single sorting machine, of two lines 9 working in parallel and together feeding this sorting machine. As mentioned above, the order of stations 2, 3, 4 and 5 can be different from that shown; station 3, for example, can be placed ahead of the others to eject too thick envelopes before any automatic reading. There could be only one ejection station common to the successive stations 2, 3 and 4 placed after the last of these. Transport of the envelopes could also be performed by an overhead conveyor belt provided with mobile clamps. Also, the local network could be replaced by a direct data link.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

We claim:

1. An installation for processing of photograph envelopes, at the input and output of a laboratory for processing these photographs, comprising a series of stations in cascade forming a continuous line with:

a device for automatic feeding and picking of envelopes, arranged to provide these envelopes one by one, standing on edge and on their large side, to an advancing conveyor belt;

a device for automatic reading of bar codes carried on the envelope, followed by a device for automatic ejection of unread envelopes;

a device for automatic checking the thickness of the envelopes, followed by a device for automatic ejection of envelopes that are too thick;

a device for automatic recognition of the shape of the films contained in the envelopes, as well as of the characters written on the envelope, followed by a device for automatic ejection of envelopes whose shape has not been recognized and/or whose characters have not been read;

a device for manual inputting and introducing into the line the previously rejected envelopes or envelopes having specia' characteristics;

a device for automatic marking of the envelopes;

a device for automatic synchronization and feeding of envelopes to a sorting machine; and computer means for receiving and recording various data coming from the different stations, and consequently providing synchronized orders to these stations.

2. The installation according to claim 1, wherein the station for automatic feeding and picking of the envelopes comprises:

a hopper for receiving envelopes, which comprises at the bottom an elevator conveyor belt;

a device for expelling superposed envelopes, placed downstream from the elevator conveyor belt;

an output ramp of the elevator conveyor belt, able to deliver envelopes on edge to a receiving conveyor belt;

a device for separating and recycling envelopes that have remained superposed on one another; and a dimension device to make vertical envelopes swing into horizontal position.

3. The installation according to claim 1, wherein the device for recognition of shapes consists of a camera placed on the one side of a line carrying the envelopes and a lighting device placed on the other side, opposite the camera, to recognize the shape by reading of its silhouette.

4. The installation according to claim 1, wherein the marking device comprises two ink jet markers, which are placed face to face, on both sides of a line carrying the envelopes.

5. The installation according to claim 1, wherein the station for synchronization and feeding of sorting machine comprises an accumulation station consisting of successive barriers placed on an advancing conveyor belt carrying the envelopes.

6. The installation wherein the series of stations according to claim 1 form a continuous line from upstream to downstream.

* * * * *